US007374451B2

(12) United States Patent
Wei et al.

(10) Patent No.: US 7,374,451 B2
(45) Date of Patent: May 20, 2008

(54) ELECTRICAL CONNECTOR

(75) Inventors: Ti-Li Wei, Tu-Cheng (TW); Guo-Jiun Shiu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/656,059

(22) Filed: Jan. 22, 2007

(65) Prior Publication Data

US 2007/0173106 A1 Jul. 26, 2007

(30) Foreign Application Priority Data

Jan. 20, 2006 (TW) ..... 95102306 A

(51) Int. Cl.
*H01R 12/24* (2006.01)

(52) U.S. Cl. ..... 439/495; 439/494

(58) Field of Classification Search ..... 439/492, 439/494, 495

See application file for complete search history.

(56) References Cited

U.S. PATENT DOCUMENTS 6,319,052 B1 * 11/2001 Chang ..... 439/495
6,352,442 B1 * 3/2002 Kudo ..... 439/260
6,517,367 B2 * 2/2003 Yamane ..... 439/260
6,551,128 B2 * 4/2003 Asai ..... 439/495
6,637,106 B2 * 10/2003 Sato et al. ..... 29/878

FOREIGN PATENT DOCUMENTS

JP 2002-10044 A 4/2002

* cited by examiner

*Primary Examiner*—Tho D. Ta
*Assistant Examiner*—Travis Chambers
(74) *Attorney, Agent, or Firm*—Wei Te Chung

(57) ABSTRACT

An electrical connector (100) comprises an insulating housing (1) defining a cavity (10), a plurality of terminals (2) arranged side by side along a lateral direction of the insulating housing. Each terminal comprises a contact beam (211, 221) with a contact portion (210, 220) exposed to the cavity and a solder portion (213, 223) extending out the insulating housing. Every at least two adjacent terminals (21, 22) forms a pair of terminals to transmit a same signal.

17 Claims, 7 Drawing Sheets

ELECTRICAL CONNECTOR

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit will be generally referred to as "FPC".

2. Description of Related Art

A conventional FPC connectors generally includes an insulating housing defining a cavity opened to a front face thereof, a plurality of terminals loaded in the housing and extending into the cavity, and an actuator assembled to the housing and movable between an open position and a close position relative to the housing. The actuator generally has a tongue insertable into the cavity, which will urge the FPC in contact with the terminals, i.e. every one terminal in contact with every one corresponding conductive pad of the FPC. The electrical connection between the FPC and terminals may be failure if some conductive pads or contact portions of the terminals are polluted or oxidized.

Therefore, an improved FPC connector is desired to overcome the disadvantages of the prior arts.

SUMMARY OF THE INVENTION

An object of the present invention is to provide an electrical connector providing a reliable electrical connection between the connector and a mating component, such as an FPC.

In order to achieve above-mentioned object, an electrical connector comprises an insulating housing defining a cavity, a plurality of terminals arranged side by side along a lateral direction of the insulating housing. Each terminal comprises a contact beam with a contact portion exposed to the cavity and a solder portion extending out the insulating housing. Every at least two adjacent terminals forms a pair of terminals to transmit a same signal.

Other objects, advantages and novel features of the present invention will become more apparent from the following detailed description of the present embodiment when taken in conjunction with the accompanying drawings.

DETAILED DESCRIPTION OF THE INVENTION

Figure 1:
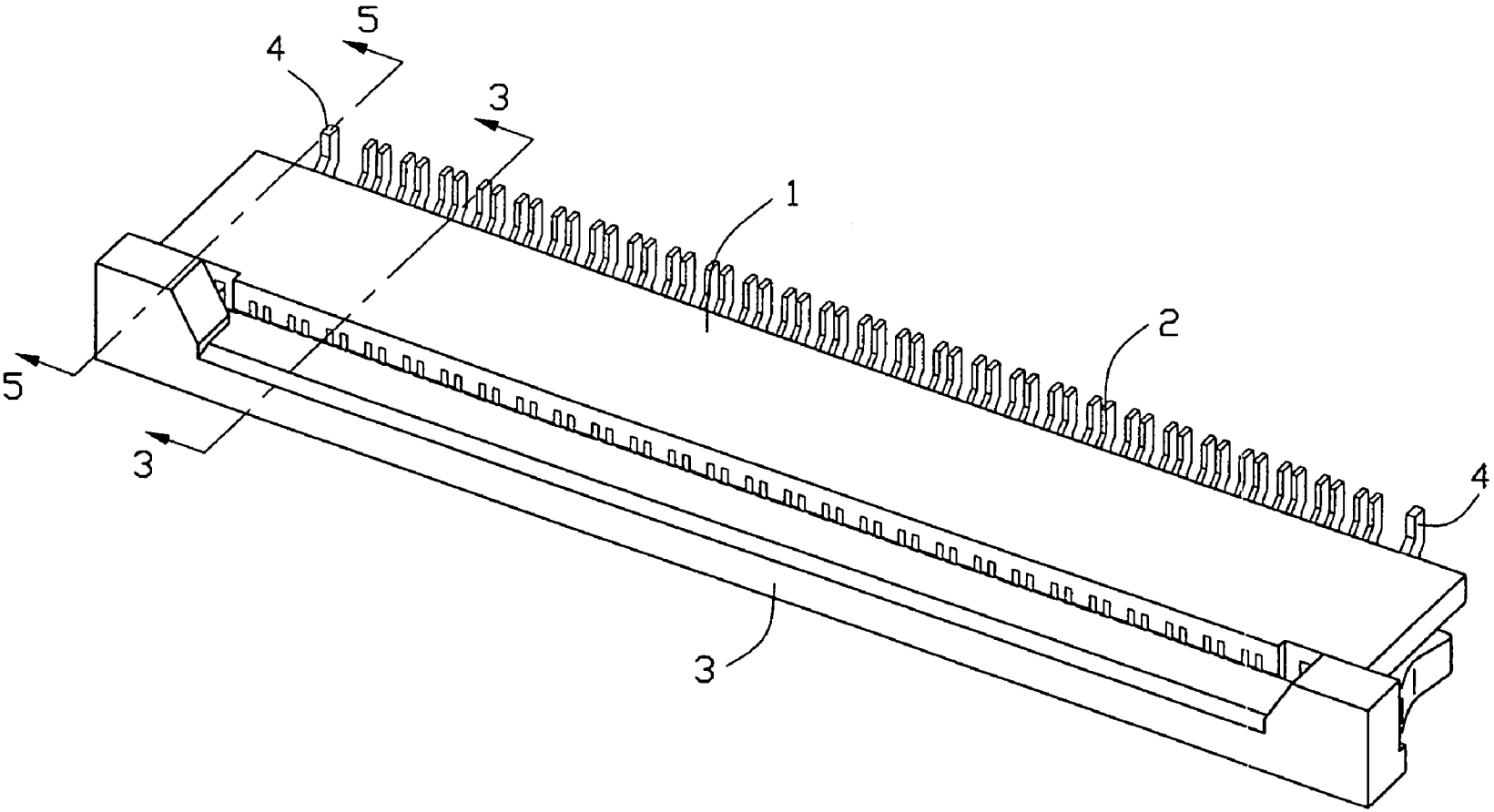
FIG. 1 is a perspective view of an electrical connector in accordance with the present invention.

Reference will now be made to the drawing figures to describe the preferred embodiment of the present invention in detail.

Figure 2:
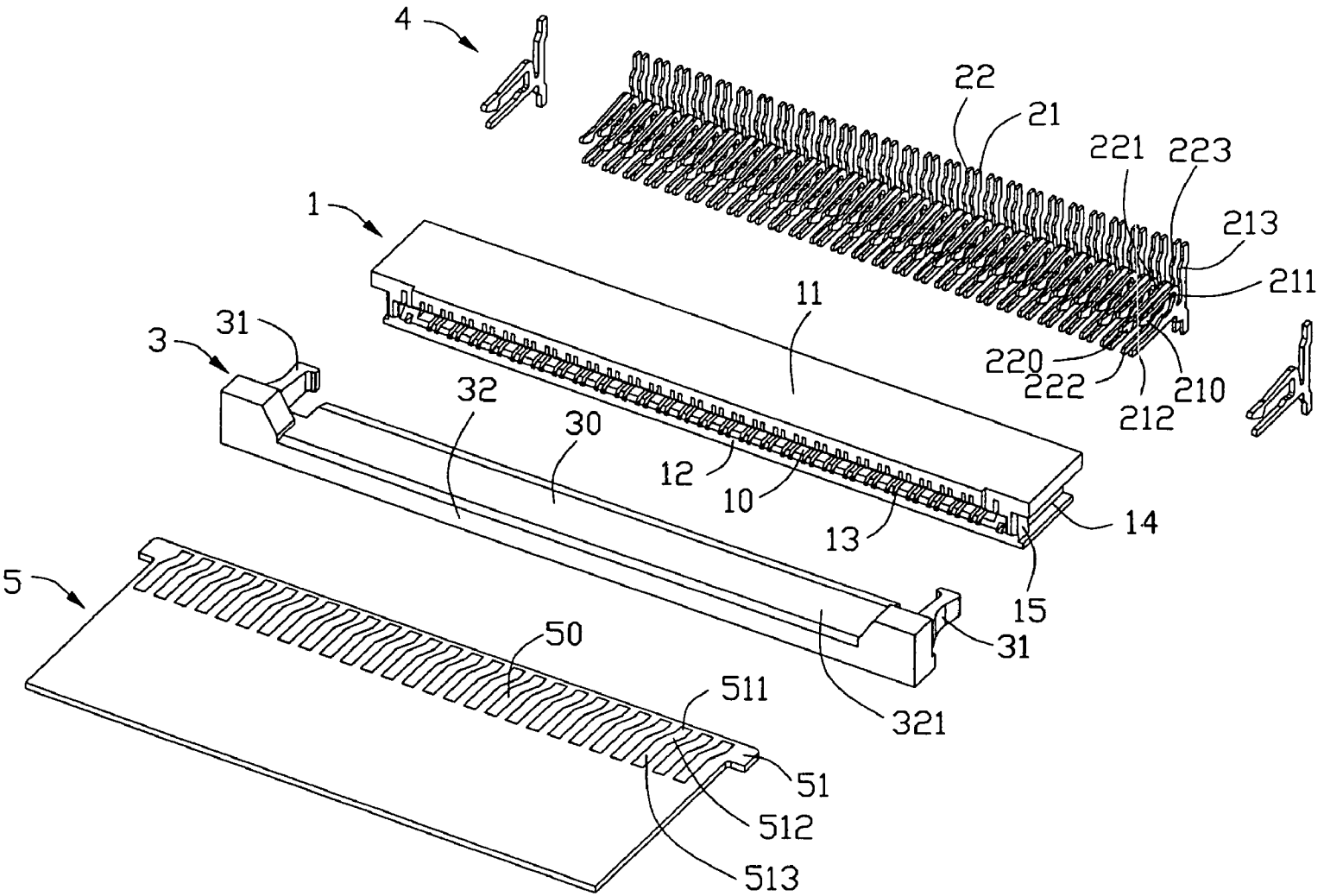
FIG. 2 is an exploded perspective view of the electrical connector shown in FIG. 1.

Referring to FIGS. 1-2, an electrical connector 100 in accordance with the present invention is adapted for connecting an FPC 5 to a printed circuit board (PCB, not shown). The connector 100 comprises an insulating housing 1, a plurality of terminals 2 retained in the housing 1, an actuator 3 detachably assembled to the housing 1, and a pair of locking members 4.

Referring to FIG. 2, the insulating housing 1 comprises opposite walls, an upper wall 11 and an lower wall 12 thereof, and a pair of lateral wall jointing the opposite walls. The four walls define an FPC receiving cavity 10 and each lateral wall has a sliding channel 14 exposed outwardly to exterior and a projection 15 formed at a front end of the sliding channels 14.

The actuator 3 comprises an elongated base 32 defining a cutout 321 in a middle section thereof, a tongue 30 flush extending backwards from a bottom of the cutout 321, and a pair of latching arms 31 extending backwards from two opposite end sections of the base 32. Each latching arm 33 has an inwardly protruding barb (not label) at a free end thereof. The latching arms 3 are sliding in the sliding channels 14. The actuator 3 is shifted from an open position where the latching arms 31 latch on corresponding lateral walls of the housing 1 via the engagement between the inwardly protruding barb and the projections 15 and the FPC 5 is permitted to be inserted in the cavity 10 along an inserting direction to a closed portion where the tongue 30 urges the terminals 2 to connect with the FPC 5.

The FPC 5 is rectangular and has a front edge which is firstly inserted into the cavity 10. The FPC has a plurality of conductive pads 50 arranged side by side in a lateral direction perpendicular to the insertion direction at front portion thereof and a pair of protrusions 51 extending outward in the lateral direction from its lateral edges adjacent the front edge. Each conductive pad 50 includes three portions, a front portion 511 near to the front edge of the FPC and a rear portion 513 and a middle portion 512 joint the front and rear portion 511, 513 together. The front and the rear portion 511, 513 are parallel to each other and offset along the lateral direction, i.e. a width direction, so the middle portion 512 is beveled the front and rear portion.

The housing 1 is provided with many pairs of terminal channels 13 which are communication with the cavity 10 and arranged laterally along the housing, and the distance between every pair of terminal channels 13 is shorter than that between two adjacent terminal channels 13 respectively belonging to adjacent two pairs. Each terminal 2 is received in the channel and comprises a contact beam 211, 221, a retention beam 212, 222 and a solder portion 213, 223. The contact beam has a contact portion 210, 220 at a front end thereof exposed to the cavity 10 for electrically contact with FPC 5. The retention beam extends substantially parallel to the contact beam 211, 221 and frictionally retained in the housing 1. The solder portion extends rearward from rear ends of the retention beam 212, 222 to connect to the PCB. In this embodiment, the terminals 2 are divided into two types, the first terminals 21 and the second terminal 22. The main difference between the first and second terminals is that the length of the contact beam 221 of the second terminal 22 is a little longer than that of the contact beam 211 of the first terminal 21. Of course, the terminals 2 are also configured in other types according to demand. One first and one second terminal are inserted into one pair of channels 13 from a rear portion of the housing and forms one pair of terminals. Also, all terminals are arranged alternatively along the longitudinal direction to form a member of pairs of terminals finally retained in corresponding pairs of channels 13.

Figure 3:
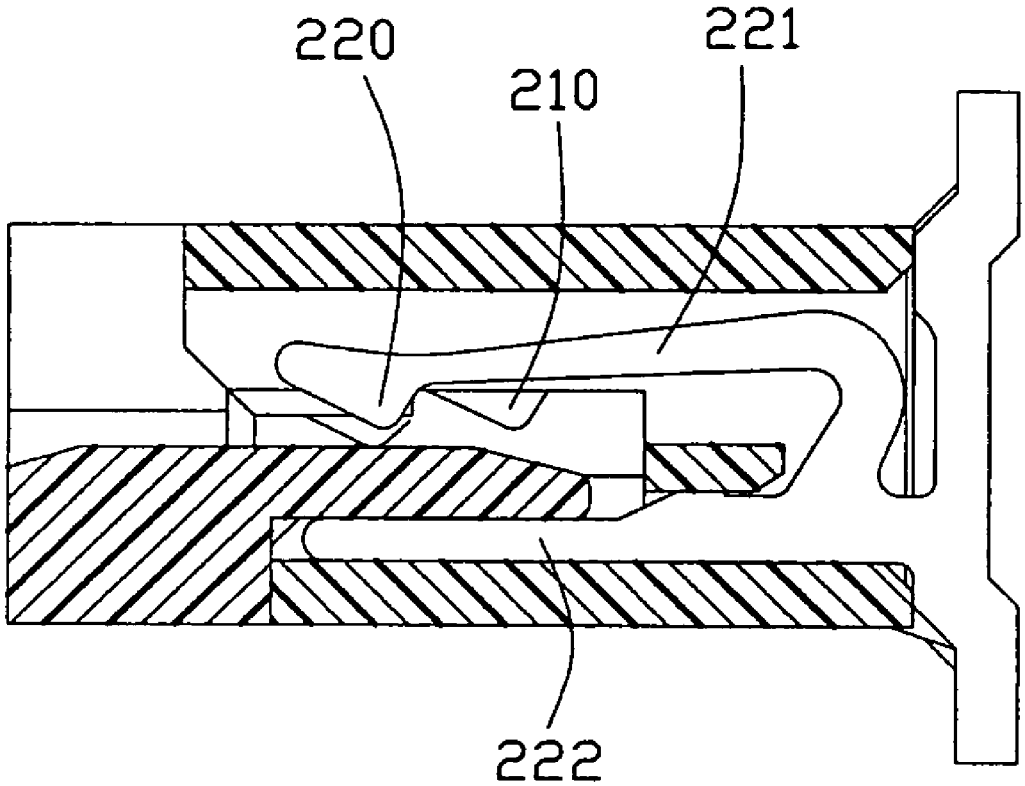
FIG. 3 is a cross-sectional view of FIG. 1 taken along line 3-3.
Figure 4:
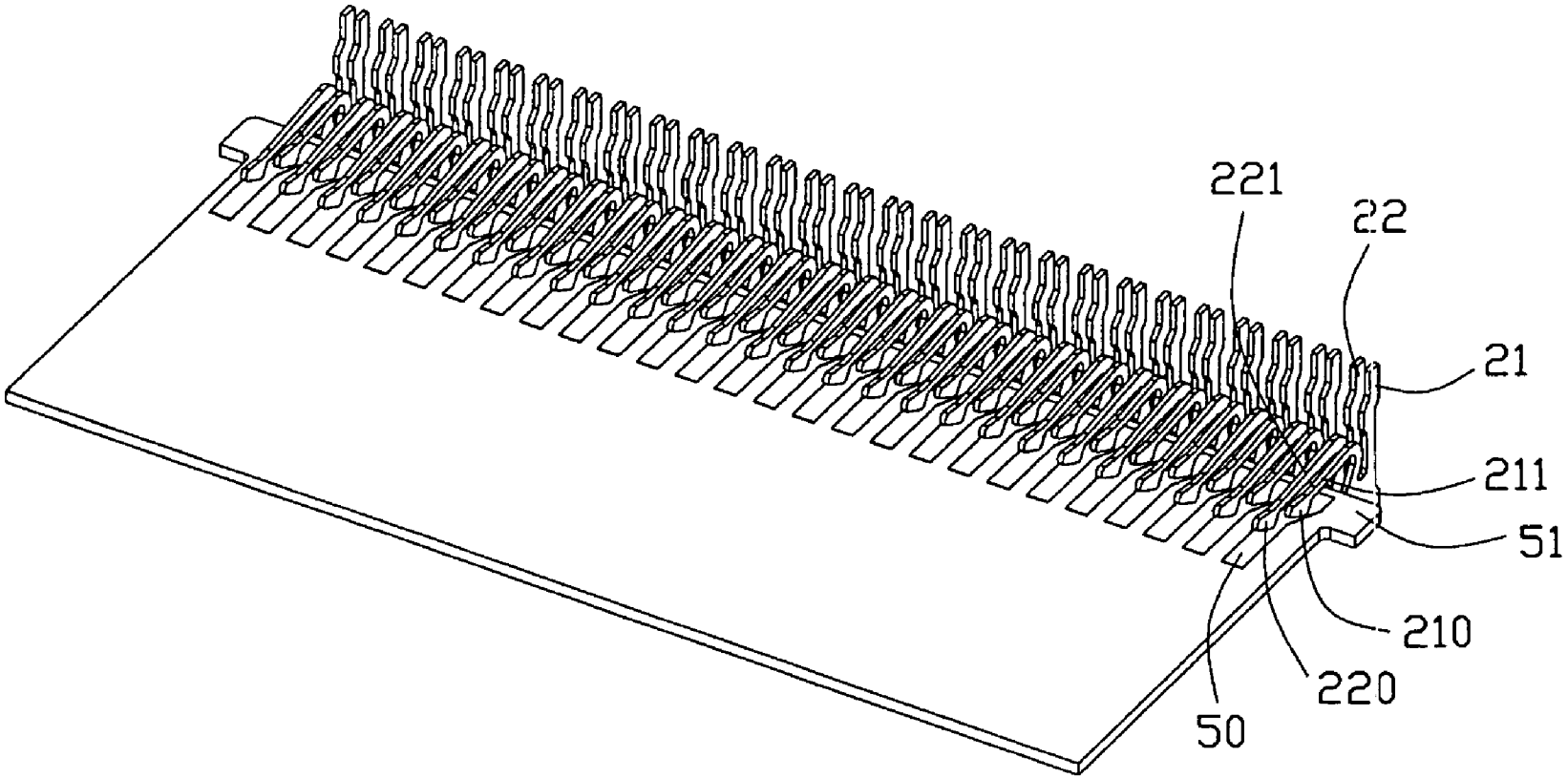
FIG. 4 is a perspective view of the terminals engaging with the FPC.
Figure 5:
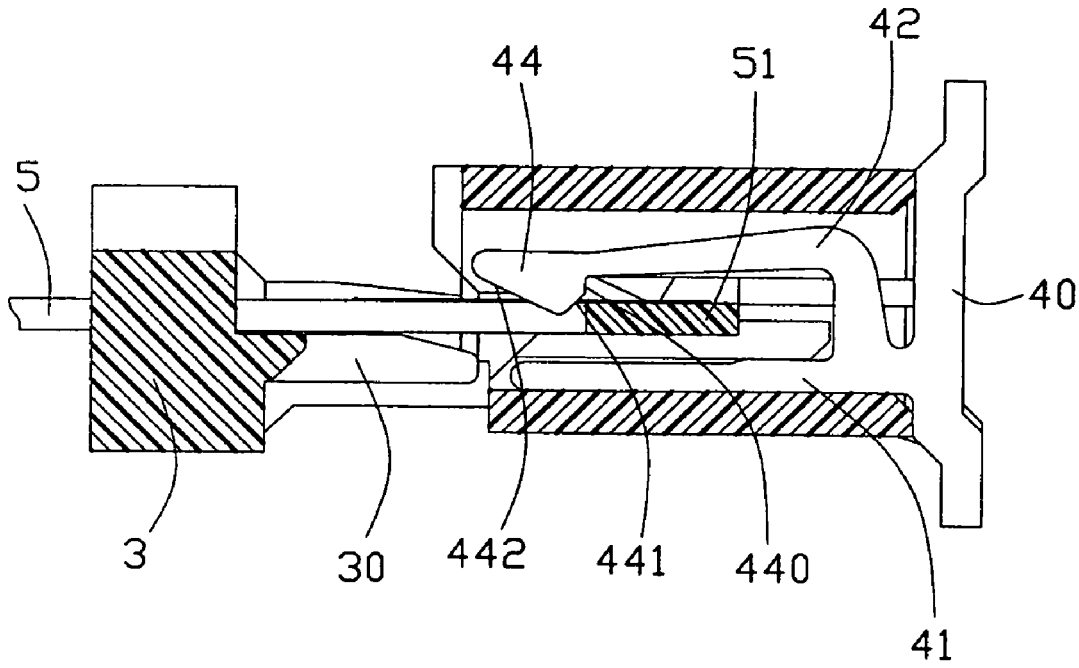
FIGS. 5 and 6 are cross-sectional views of FIG. 1 taken along line 5-5, but respective showing the FPC un-completely and completely inserted into the cavity.
Figure 6:
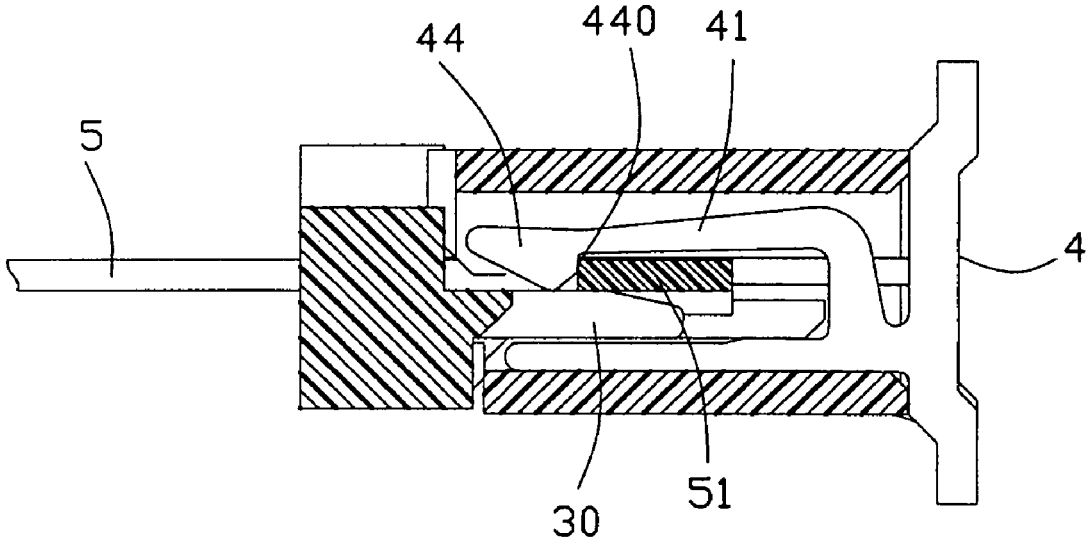

As FIG. 3 shown, the contact portions 210, 220 of each pair are staggered in the insertion direction, which will decrease insertion force of the tongue to the cavity. As FIG. 4 shown, each pair of the terminal 2 engages each corresponding conductive pad 50. The contact portions 210 of the first terminals engage with the front portions of conductive pads and the contact portions 220 of the second terminals engage with the middle portions of said conductive pads. The solder portions of each pair are simultaneously connected with one solder pad of the PCB so that the first terminal and second terminal of each pair can transmitted the same signal. Although some portions of the conductive pads 50 may be oxidized or covered by dust or other external materials, at least one of the contact portions 210, 220 of each pair can electrically connect with the conductive pad 50, and thus this configuration of the electrical connector can efficiently prevent open-circuit taking place. Alternatively, the contact portions 210 of the first terminals 21 may be engaged with the rear portions of the pads 50. The bended conductive pads 50 can ensure enough engagement area of the contact portions without increasing the width of the conductive pads 5. Also, the two contact beams of said pairs may be with a same length and engage with conventional conductive pads in juxtaposition if width of pads is enough. Each pair of terminals also includes three terminals and more to transmit the same signal if width of the conductive pads of the FPC 5 permits.

Figure 7:
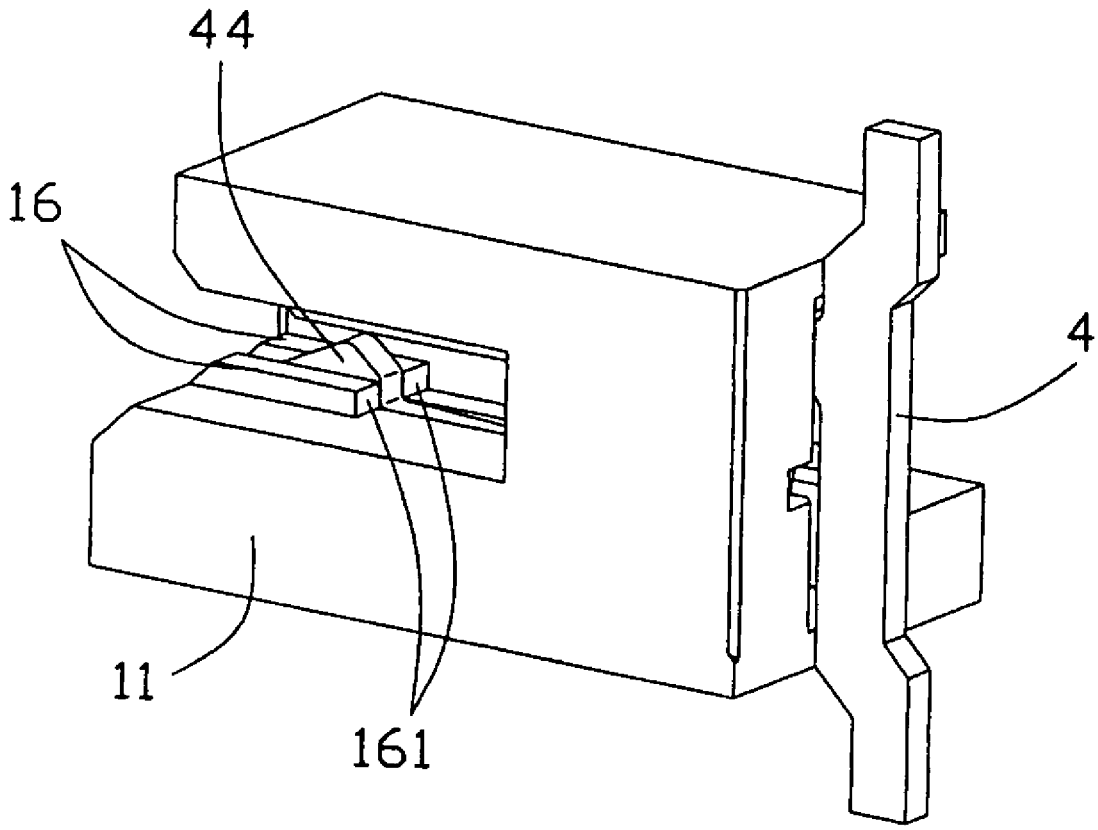
FIG. 7 is a partly perspective view of the electrical connector showing the retaining tubers 16.

Referring to FIGS. 2, 5-7, the locking member 4 is similar to the terminal 2 and includes a main portion 40, a retention beam 41 extending perpendicular to the main portion 40 to be frictionally secured in the lower wall 12 of the housing 1, and a latching beam 42 branching from retention beam 41 and extending substantially parallel to the retention beam 41 to be received in the upper wall 11 of the housing 1. The latching beam 42 has a projection 44 at front end thereof for retaining in the protrusion 51 of the FPC 5 in the cavity 10. The projection 44 defines a latching surface 440 perpendicular to the insertion direction of the FPC 5, a first guiding surface 441 which is formed at an obtuse angle to the latching surface 440 for facilitating the FPC 5 being removed out of the housing 1 and a second guiding surface 442 formed at a certain angle to the first guiding surface 441 for facilitating the FPC 5 being inserted into the housing 1. As FIG. 7 shown, the housing further includes a plurality of retaining tubers 16 on the upper wall 11 of housing 1 beside the locking members 4. Each retaining tuber 16 has a latching surface 161 which extends substantially perpendicular to the insertion direction. When the FPC 5 is completely inserted in the cavity 10, the latching surfaces 161 and the latching surfaces 440 of the locking members 4 are located behind the protrusions 51 so that the FPC 5 is restricted in unexpectable movement. The height of latching surface 161 is configured to be not higher than that of the latching surface 440 in the latching member's 4 released position.

When the actuator 3 is in the open position, the FPC 5 is inserted into the cavity 10 along the tongue 30, and the protrusions 51 extend beyond the latching surfaces 440, 161 in the insertion direction. Then the actuator 3 is pushed toward to the closed position, the tongue exerts gradually enlarged force on the FPC 5. The FPC 5 is shifted upward by the tongue 30 until the latching surfaces 440, 161 latch on the protrusions 51, thereby the actuator 3 is in the closed position. For defining the latching surfaces 440, 161, the FPC 5 is stably retained in the housing, and thus a preferable electrical connection of the electrical connector is accordingly achieved.

When the FPC 5 is required to back toward the open position, firstly the actuator 3 is moved back, that is, the tongue 30 is pulled out, thereby the FPC 5 is released downward till the protrusions 51 break off the latching surfaces 440, 161. Finally the FPC 5 arrives at the open position in light of the guidance of the first guiding surfaces 441.

However, the disclosure is illustrative only, changes may be made in detail, especially in matter of shape, size, and arrangement of parts within the principles of the invention.

What is claimed is:

1. An electrical connector comprising:

an insulating housing defining a cavity for receiving a sheet-like member defining a plurality of conductive pads;

a plurality of terminals arranged side by side in a lateral direction of the insulating housing and each comprising a contact beam with a contact portion exposed to the cavity; wherein every at least two adjacent terminals forms a pair of terminals and the contact portions of the pair engage with one corresponding conductive pad to transmit a same signal;

wherein each conductive pad comprises two portions offsetting a little along the lateral direction to engage with contact portions of each pair respectively.

2. The electrical connector as described in claim 1, wherein a distance between the terminals of said pair is shorter than that between adjacent terminals respectively belonging to adjacent said pairs.

3. The electrical connector as described in claim 1, wherein the contact portions of said pairs are staggered in an inserting direction of the contact beams inserted into the cavity.

4. The electrical connector as described in claim 1, wherein the terminals comprise a retention beam parallel to the contact beam and retained in the housing.

5. The electrical connector as described in claim 1, further comprising an actuator, the actuator movable from an open position where the sheet-like connection member is permitted into the cavity and a close position where the actuator urges the sheet-like connection member to engage with the contact portions of terminals.

6. The electrical connector as described in claim 5, wherein the insulating housing comprises a pair of sliding channels in two opposite lateral walls thereof and the actuator comprises a latching arms sliding in the sliding channels and a tongue movable into the cavity.

7. An electrical connector assembly comprising:

an insulative housing defining an elongated slot along a first direction and communicating with an exterior in a second direction perpendicular to said first direction;

a plurality of contacts arranged at least in one row and disposed in the housing beside said slot with corresponding contacting sections extending into the slot;

a printed circuit board inserted into the slot;

a plurality of conductive pads side by side arranged along a front edge of the printed circuit board, each of said conductive pads defining two contact regions distanced from each other in both said first and second directions so as to engage the contact sections of the corresponding adjacent two contacts, wherein said two contact sections are also arranged spaced from each other in both the first and second directions.

8. The assembly as claimed in claim 7, wherein said contacts are arranged with pairs each having two adjacent contacts for engagement with the corresponding conductive pad.

9. The assembly as claimed in claim 8, wherein a distance between the neighboring pair is larger than that between contacts of the pair.

10. The assembly as claimed in claim 8, wherein each of the conductive pads includes at least an oblique region and a straight region on end of said oblique region.

11. The assembly as claimed in claim 10, wherein each of said conductive pads further includes another straight region located on the other end of the oblique region.

12. An electrical connector assembly comprising:

a insulative housing defining an elongated slot along a first direction and communicating with an exterior in a second direction perpendicular to said first direction;

a plurality of contacts arranged at least in one row and disposed in the housing beside said slot with corresponding contacting sections extending into the slot;

a printed circuit board inserted into the slot;

a plurality of conductive pads side by side arranged along a front edge of the printed circuit board, each of said conductive pads being not rectangular and defining two contact regions distanced from each other in at least one of said first and second directions so as to engage the corresponding two contact sections, wherein said two contact sections are also arranged spaced from each other in said at least one of the first and second directions.

13. The electrical connector assembly as claimed in claim 12, wherein said two contact sections respectively belong to two adjacent contacts.

14. The electrical connector assembly as claimed in claim 12, wherein said two contact regions are distanced from each other in both said first direction and said second direction.

15. The electrical connector assembly as claimed in claim 14, wherein both said two contact sections are spaced from each other in both said first direction and said second direction.

16. The assembly as claimed in claim 12, wherein each of the conductive pads includes at least an oblique region and a straight region on end of said oblique region.

17. The assembly as claimed in claim 16, wherein each of said conductive pads further includes another straight region located on the other end of the oblique region.

* * * * *